US005277264A

United States Patent [19]

Song et al.

[11] Patent Number: 5,277,264

[45] Date of Patent: Jan. 11, 1994

[54] HYDROPNEUMATIC HAMMER

[75] Inventors: Kyo-Myung Song; Myeong-Soo Jang, both of Kyong gi-do, Rep. of Korea

[73] Assignee: Soosan Heavy Industries Co., Ltd., Kyonggi-do, Rep. of Korea

[21] Appl. No.: 989,856

[22] Filed: Dec. 14, 1992

[30] Foreign Application Priority Data

Jan. 15, 1992 [KR] Rep. of Korea ..... 491

[51] Int. Cl.[5] ..... E21B 4/06; E21B 11/02

[52] U.S. Cl. ..... 175/296

[58] Field of Search ..... 175/296, 293, 297, 298, 175/91, 92, 19-23

[56] References Cited

U.S. PATENT DOCUMENTS

| | | | |
|---|---|---|---|
| 3,491,838 | 1/1970 | Wilder et al. | 175/296 |
| 4,964,477 | 10/1990 | Tupitsyn et al. | 175/296 |
| 5,085,284 | 2/1992 | Fu | 175/296 |
| 5,193,627 | 3/1993 | Jenne | 175/19 |

*Primary Examiner*—Thuy M. Bui

*Attorney, Agent, or Firm*—Lowe, Price, LeBlanc & Becker

[57] ABSTRACT

A hydropneumatic hammer operated by a reciprocal action of a percussive piston and a directional control valve, comprising a piston having steps of larger and smaller diameters separating the interior of a piston chamber intended for admitting said piston into four chambers, a first chamber communicating by way of a first passage with a pressure line, the second chamber being defined by a step of middle portion of said piston connecting to a discharge line, the third one being defined by a step formed on an upper portion of said piston, and the fourth one defining a gas chamber separated from the third chamber by a seal retainer, a valve chamber intended for admitting a valve system, being arranged parallel to said piston chamber, a passage for converting a pressure line of fluid or oil into a discharge line and connecting said valve chamber with the second chamber, a passage for returning an exhausted fluid or oil being converted into depressurized condition after working, a first passage intened for delivering a fluid under pressure from said inlet port into the first chamber, a second passage intended for delivering a fluid under pressure from said inlet port into said valve chamber and self-pressurable chamber, and a passage intended for communicating said valve chamber with the third chamber.

3 Claims, 5 Drawing Sheets

HYDROPNEUMATIC HAMMER

BACKGROUND OF THE INVENTION

The present invention relates to civil engineering and road construction machinery, more particularly to a hydropneumatic hammer which operates by a reciprocal action of a percussive piston and a directional control valve.

In general a hydropneumatic percussive tool according to the prior art pertaining to this invention comprises a gas chamber so arranged in the upper position of the piston as to accumulate percussive energy by its compression during upstroke of the piston.

A delivered oil under pressure into a chamber which is generally made around the lower portion of a piston makes the piston move upward compressing the gas contained in the gas chamber until it reaches its full upstroke position and when the piston reaches its full upstroke position, another chamber which is generally provided around the upper portion of the piston is filled with a pressurized oil by an operation of a directional control valve and this causes the pressure of oil acting on said lower-positioned chamber to be countervailed and results in revelation of the accumulated energy of the gas and accordingly the piston comes to drop instantaneously to strike the head of the percussive rod disposed coaxially with the piston.

The kind of device as described above generally needs special components such as a valve plug or a valve cock to convert the valve and it further needs very complicated passageways like a maze to make the upper-positioned chamber become filled with a fluid under pressure to drop the piston.

Consequently the device of this type is commonly disadvantageous in that it is large in size and heavy in weight because of use of the special components to operate the control valve and the complicated passageways for the fluid to travel and these disadvantages also result in the high cost of production as well as the frequent and difficult repair work.

In the field of hydraulic engineering, it should be noted that long and/or crooked passageways for fluid deteriorate the energy efficiency of the device while on the other hand, short and direct ones were found to be highly advantageous.

It is therefore an object of the present invention to make the percussive tool which is operated in a hydropneumatic manner to be small in size, light in weight and simple in construction, and also to be minimal in cost of production.

Another object of the present invention is to improve the efficiency of the device by adoption of simplicity of passageways.

Still another object is to improve the operational stability and the reliability of the device.

SUMMARY OF THE INVENTION

These and other objects can be attained in a hydropneumatic hammer having a percussive rod, a front head intended for receiving from one end thereof a lower end portion of a piston and from the opposite end thereof said percussive rod disposed coaxially with said piston and limiting the stroke length and the moving direction of said percussive rod and piston, a cylinder which is provided with a piston and a directional control valve system, and a back head which serves to define a gas chamber, by that said hydropneumatic hammer comprises a piston having steps of larger and smaller diameters separating the interior of a piston chamber intended for admitting said piston into four chambers, a first chamber communicating by way of a first passage with a pressure line, the second chamber being defined by a step of middle portion of said piston connecting to a discharge line, the third one being defined by a step formed on an upper portion of said porton, and the fourth one defining a gas chamber separated from the third chamber by a seal retainer; a valve chamber intended for admitting a valve system, being arranged parallel to said piston chamber; a passage for converting a pressure line of fluid or oil into a discharge line and connecting said valve chamber with the second chamber; a passage for returning exhausted fluid or oil being converted into a depressurised condition after working; a first passage intended for delivering fluid under pressure from said inlet port into the first chamber; a second passage intended for delivering fluid under pressure from said inlet port into said valve chamber and self-pressurable chamber; and a passage intended for communicating said valve chamber with the third chamber.

These and other objects, advantages and features will become apparent from the detailed description of the preferred embodiment for carrying out the invention that follows.

DETAILED DESCRIPTION OF THE INVENTION

Figure 1:
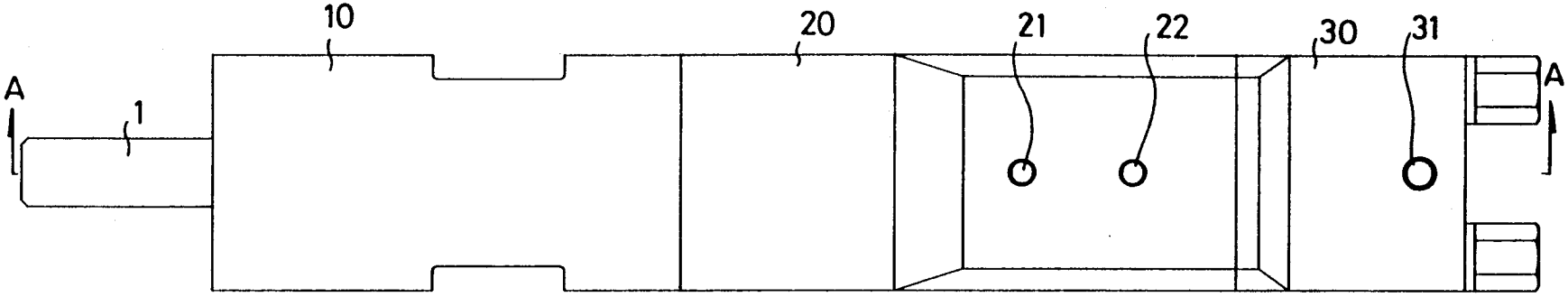
FIG. 1 is a plane view of a hydropneumatic hammer according to the invention.

FIG. 1 is an overall plan view of a hydropneumatic hammer according to the invention, showing a percussive rod(1), a front-head(10), a cylinder(20) having an inlet port(21) intended for admitting a pressurized fluid from any known hydro-power unit(not shown) and an outlet port(22) intended for discharging an exhausted fluid after work, and a back-head(30) having a port which serves to fill up a gas.

Figure 2:
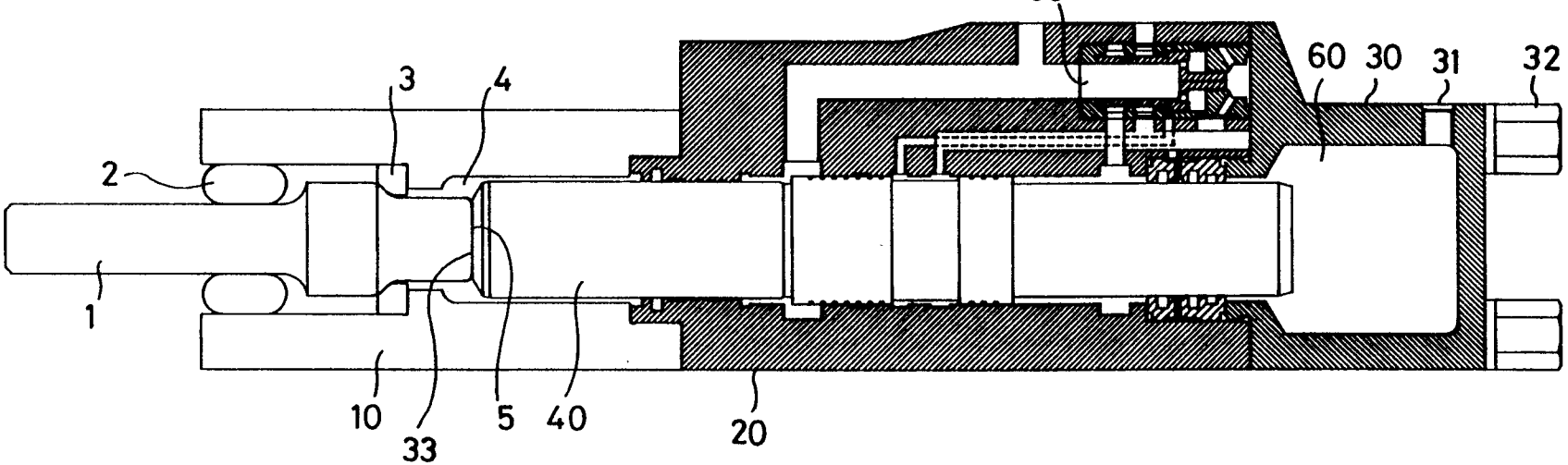
FIG. 2 is a longitudinal sectional view taken along line A—A of FIG. 1 showing the inner structure of the hydropneumatic hammer.

FIG. 2 is a longitudinal sectional view taken along line A—A of FIG. 1 showing that the hydropneumatic hammer according to the invention comprises a front-head(10), a cylinder(20) and a back-head(30).

The front-head(10) has an axial hole(4) adapted to receive from one end thereof the lower end portion of the piston(40) and from the opposite end thereof said percussive rod(1) disposed coaxially with said piston(40).

The front-head(10) further has an annular guide(2) and a trust ring(3), both of these so secured to the inner surface of said hole(4) as to serve as limiting the stroke length and the moving direction of said percussive rod(1) and piston(40).

The cylinder(20) is provided with an axial piston chamber intended for slidingly admitting said piston(40) disposed coaxially with said percussive rod(1), and a valve chamber(50) disposed parallell with said piston chamber.

Secured by bolts(32), the upper side of the cylinder(20) is a back-head(30) serving to define a gas chamber(60).

Figure 6A:
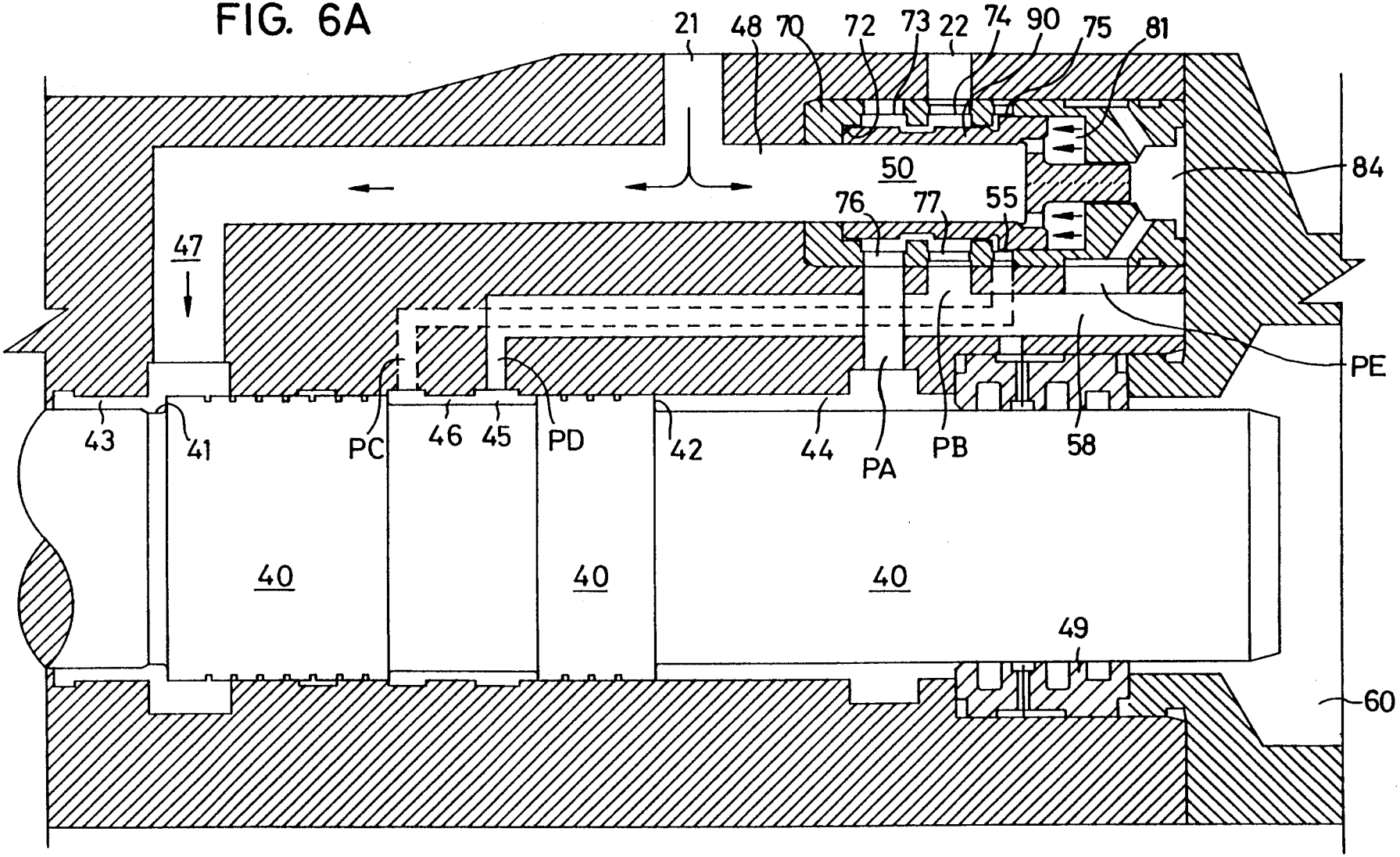
FIG. 6A is a longitudinal sectional view taken along the line A—A of FIG. 1 showing the piston position in its full downstroke (striking moment).
Figure 6B:
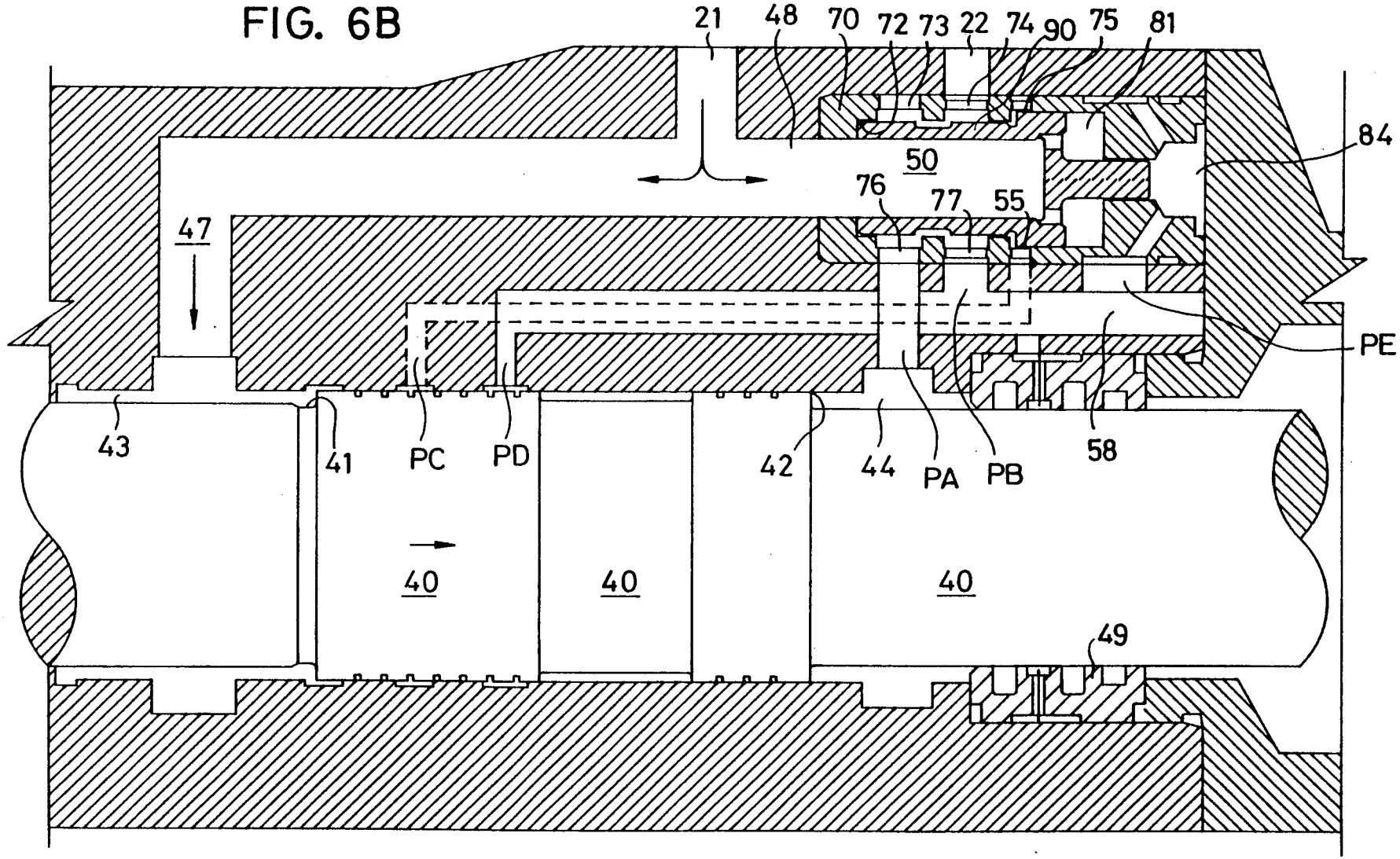
FIG. 6B is similar to FIG. 6A with the piston being shown in its upstroke.
Figure 6C:
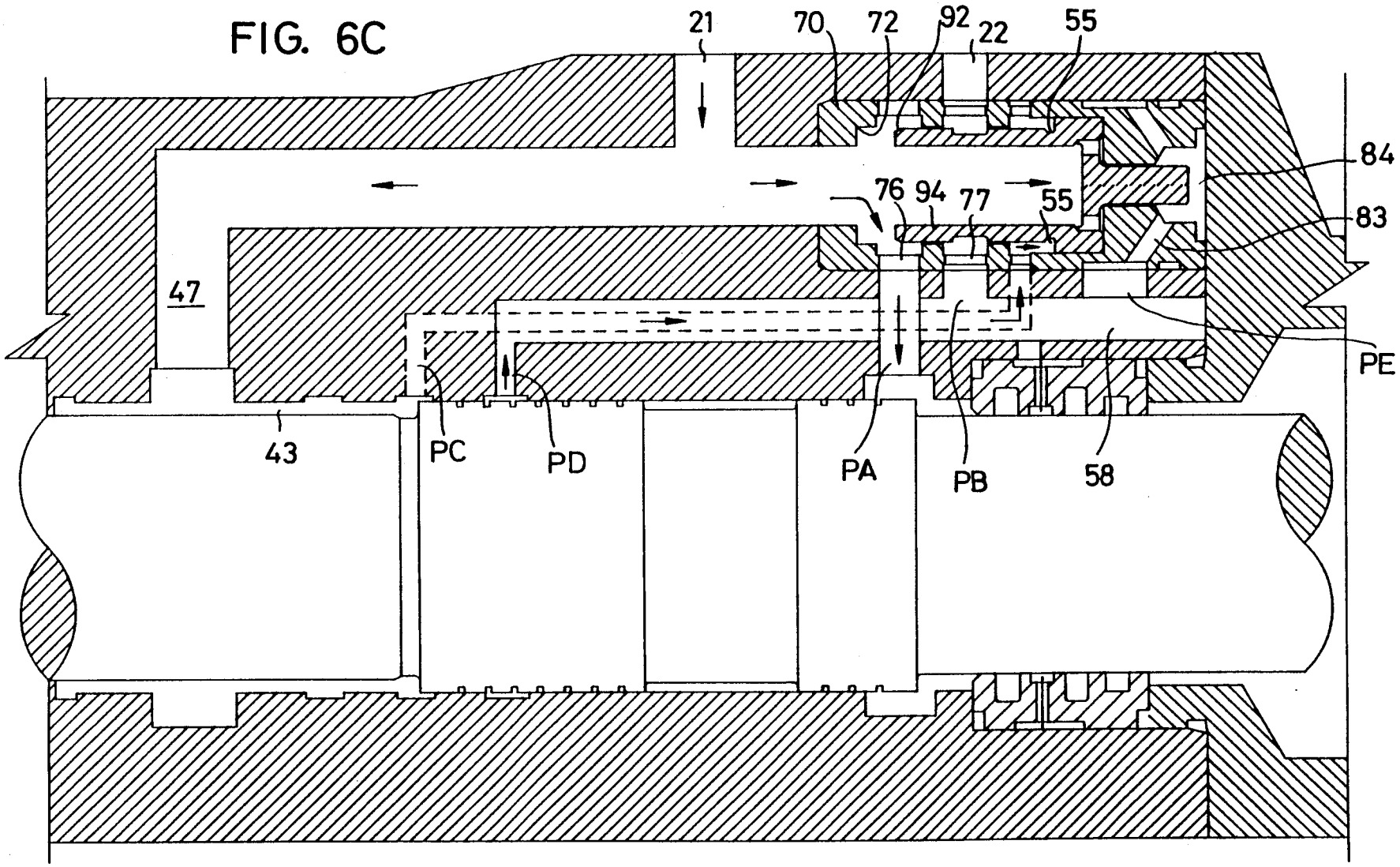
FIG. 6C is similar to FIG. 6A with the pistion being shown in its full upstroke(valve converting moment).

FIG. 6A to 6C show a construction of the piston(40) and a directional control valve system which achieve the characteristic features of the invention and the reciprocal communication between said piston(40) and said valve system.

Figure 3:
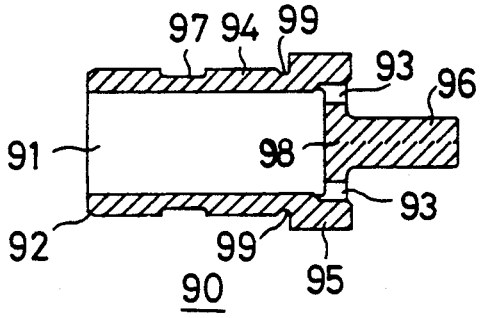
FIG. 3 is a sectional view of a spool slidingly inserted in the valve of the hydropneumatic hammer according to the invention.
Figure 4:
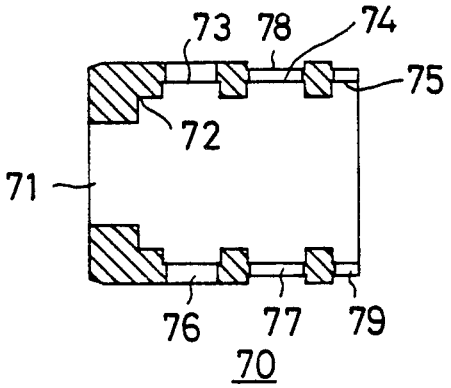
FIG. 4 is a sectional view of the valve of the hydropneumatic hammer according to the invention.
Figure 5:
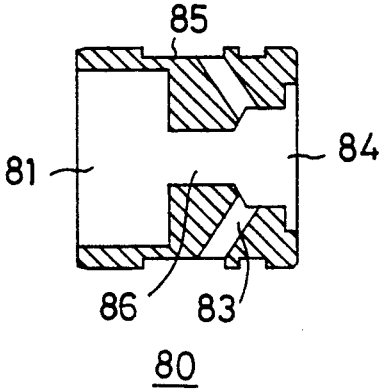
FIG. 5 is a sectional view of a valve cover of the hydropneumatic hammer according to the invention.

FIG. 3 to 5 illustrate in detail a valve, a spool mounted slidingly inside the valve, and a valve cover to be arranged linearly with the valve.

As seen in FIG. 6A to 6C, arranged inside piston chamber of the cylinder(20) for axial reciprocations therein is the piston(40) having steps of larger and smaller diameters separating the interior of the piston chamber into four chambers, the first(43) of the chambers communicating by way of a first passage(47) being connected with the pressure line, the second chamber(46) connecting with the discharge line, the third one(44) being defined by the step(42) of a small diametered portion of the piston, and the fourth one constituting the gas chamber(60) separated from the third one by a seal retainer(49).

Also arranged inside parall to said piston chamber of the cylinder for axial reciprocation therein is a cylindrical valve chamber(50). In the valve chamber(50), a cylindrical valve(70) with an axial section shaped as illustrated in FIG. 4 and a valve cover(80) shaped as illustrated in FIG. 5 are secured in a straight line meeting both ends thereof, and a hollow cylindrical spool(90) having such a section shaped as illustrated in FIG. 3 is inserted slidingly in said valve(70) and said valve cover(80).

The outer diameter of said valve(70) is the same as the inner diameter of said valve chamber(50) and is provided with a port(76) intended for connecting said valve chamber(50) with the third chamber(44) by way of a passage(PA).

Further, the inner surface of the lower end portion of said valve has an annular step(72) to receive a lower end portion(92) of said spool(90), and the inner surface of the middle portion of said valve(70) has a first and second annular groove(73)(74), and the inner surface of an upper end portion of said valve has an annular step(75) to receive the outer surface of the large-diametered portion(95) of said spool(90).

On the first annular groove(73) of said valve(70) there are holes with an equal distance of radial direction, one(76) of which is communicated by way of the passage(PA) with the third chamber(44) made around an upper portion of the piston(40).

On the second annular groove(74) there are also holes with an equal distance of radial direction, one(77) of which is communicated with a chamber(58) by way of a passage(PB), and another hole(78) formed at the opposite direction of said hole(77) is connected with the discharging port(22).

The spool(90) mounted slidingly inside said valve(70) accommodates a small-diametered portion(94) and a large-diametered portion(95) as illustrated in FIG. 3, an axial opening(91) made in the lower end thereof with the same diameter as a second passage(48), several axial holes(93) formed in an upper end plate(98) in a radial symmetry, and a cylindrical projection(96) so formed on the center of said end plate(98) outwardly as to be inserted into an axial hole(86) made in said valve cover(80) described in FIG. 5 in a manner of sliding but air-tightening.

Further, on the outer surface of said small-diametered portion(94) and on the outer step formed between said small-diametered portion(94) and said large-diametered portion(95) of said spool are formed annular grooves(97)(99) respectively.

The valve cover(80) with an axial sectional shape as illustrated in FIG. 5 has a cylindrical recess(81) of which inner diameter is the same as the outer diameter of the large-diametered portion(95) of the spool(90) and defines a chamber within which said spool(90) can be slid back and forth, and this recess(81) makes a self-pressurable chamber whose function will be explained in detail later.

Further said valve cover(80) has an axial hole(86) in order for said cylindrical projection(96) of the spool to be fitted slidingly but air-tightly therein and an annular groove(85) so formed on the outer surface thereof as to be communicated with a depressurized chamber(84) by way of declined passages(83), which are connected with the chamber(58) intended to return and discharge the exhausted fluid after working by way of a passage(PE).

The hydropneumatic hammer according to the embodiment of the invention described above operates in the following manner:

Prior to operation, the chamber(60) is filled with an inert gas, such as nitrogen or carbon dioxide or the like by way of the port(31) from a compressed gas tank or a compressor (not shown) or any known suitable hydropower unit construction.

FIG. 6A shows the position of the piston(40) and the spool(90) in their full downstroke at the striking moment.

Upon the engagement of the pump, the oil being pressurized is admitted from the inlet port(21) into the first chamber(43) by way of the first passage(47) and into the self-pressurable chamber(81) through the second passage(48) and the axial holes(93) formed in the upper plate(98) of the spool(90).

The oil delivered under pressure into said first chamber makes the piston move upward compressing the gas contained in the chamber(60) by putting oil pressure on the lower annular step(41) of the piston, and the oil delivered under the same pressure through the second passage(48) and the axial holes(93) formed in the upper plate(98) of the spool(90) in a radial symmetry into the self-pressurable chamber(81) makes the said spool(90) move in the direction of the arrow in order for the valve chamber(50) not to be connected with the third chamber(44).

Therefore at this stage, the force being applied on the piston is only the oil pressure acting on said first chamber(43) and the gas pressure acting on the upper head of the piston in the opposite direction, and here, the piston is moving upward since the oil pressure surpasses the gas pressure.

FIG. 6B is similar to FIG. 6A with the piston being shown in its more upstroke position and FIG. 6C shows the piston in its full upstroke position. At the stage of the full upstroke position of the piston, the first chamber(43) is connected with a passage(PC) serving to convert the oil pressure, and accordingly the oil under pressure acting on the first chamber travels through a radial passage defined by the inner step(75) and the holes(79) formed on the step of the upper end of the valve(70) and causes the spool(90) to be converted and moved to the upper direction by putting oil pressure on the valve converting chamber(55) which is made by both the outer step(99) formed between the small-diametered portion and the large-diametered portion of said spool and the inner step(75) of the upper end of the valve(70). Here even though the pressure acting on said valve converting chamber(55) is the same as that on the self-pressurable chamber(81), since in the effective area receiving the pressure the party of said valve converting chamber(55) is greater than the self-pressurable chamber(81), the operation of the valve converting can be accomplished, and accordingly this causes the hole(76) formed on the first annular groove of the valve to be opened and at the same time, the hole(77) formed on the second annular groove of the valve being closed by the outer surface of the spool stopping up the inner surface of the valve.

Due to the opening of the hole(76) formed on the first annular groove(73) of the valve, the oil supplied under pressure into the valve chamber(50) runs directly via the passage(PA) into the third chamber(44) which is formed around the upper portion of the piston and causes the oil pressure acting on the first chamber to be countervailed and the gas to reveal instantaneously its accumulated energy which is acquired during the upstroke of the piston.

Here, the equivalence of oil pressure between the first chamber(43) and the third chamber(44) is sufficient to reveal the accumulated energy of the gas; however, it is desirable to make the effective area receiving pressure of the third chamber larger than that of the first chamber in view of energy efficiency. Therefore, in the hydropneumatic hammer according to the present invention, the height of the step(42) of the third chamber(44) is a little larger than or the same as that(41) of the first chamber(43).

The full downstroke of the piston can again be explained by FIG. 6A..

At this stage, the passage(PC) is cut off from the first chamber, and the second chamber(46) formed around the middle portion of the piston makes the passage(PC) communicate with a returning passage(PD) and accordingly causes the oil supplied under pressure into said passage(PC) to become depressurized; and, at the same time, the oil pressure so having acted on the valve converting chamber(55) as to move the spool to the upper direction becomes exhausted and therefore the spool is changed to the opposite direction by the oil supplied under pressure into said self-pressurable chamber(81) and stops up the hole(76) which is connected with the passage(PA). Consequently, the fluid delivered into the third chamber(44), which communicates with the returning passage(PD) by way of the passage(PA) and (PB) and the hole (76) and (77) becomes depressurized and is discharged via the outlet port(22) through the upstroke of the piston.

As the piston of the hydropneumatic hammer according to the invention can be operated by only one valve converting chamber and one self-pressurable chamber, and the oil can be so delivered directly into the first and the third chamber from the inlet port as to minimize the loss of pressure and to maximize the energy efficiency, the device according to the invention is advantageous in size, weight, energy efficiency and complexity of construction.

What is claimed is:

1. A hydropneumatic hammer having a percussive rod, a front head intended for receiving from one end thereof a lower end portion of a piston and from the opposite end thereof said percussive rod disposed coaxially with said piston and for limiting the stroke length and the moving direction of said percussive rod and piston, a cylinder which is provided with the piston and a valve system, and a back head which serves to define a gas chamber, said hydropneumatic hammer is characterized in that it comprises:

(a) a piston having steps of larger and smaller diameters separating the interior of a piston chamber intended for admitting said piston into four chambers, a first chamber communicating by way of a first passage with a pressure line, the second chamber being defined by a step of middle portion of said piston connecting to a discharge line, the third one being defined by a step formed on an upper portion of said piston, and the fourth one defining a gas chamber separated from the third chamber by a seal retainer;

(b) a valve chamber intended for admitting a valve system, being arranged parallel to said piston chamber;

(c) a passage for converting a pressure line of fluid or oil into a discharge line and connecting said valve chamber with the second chamber;

(d) a passage for returning an exhausted fluid or oil being converted into a depressurised condition after working;

(e) a first passage intended for delivering fluid under pressure from said inlet port into the first chamber;

(f) a second passage intended for delivering fluid under pressure from said inlet port into said valve chamber and self-pressurable chamber; and, (g) a passage intended for communicating said valve chamber with the third chamber.

2. A hydropneumatic hammer as set forth in claim 1, wherein said valve system comprises:

(a) a hollow cylindrical valve having an outer diameter being the same as the inner diameter of said valve chamber, an inner diameter being the same as of said second passage, an axial opening made in a center portion of the lower end thereof, an annular step so formed on inner surface of a lower end thereof as to slidingly admit a lower end of a spool, a first and a second annular groove made in the inner surface of a middle portion thereof, said first annular groove having several holes formed in a radial symmetry therein and one of said holes being connected by way of the passage with said third chamber, and said second annular groove having several holes formed in a radial symmetry therein and one of said holes being connected with the returning passage and another in the opposite direction of said hole being connected with said outlet port, and an annular step so arranged on the inner surface of an upper end thereof as to slidingly admit a large-diametered portion of said spool, said annular step having several holes formed in a radial symmetry therein and one of said holes being connected to said converting passage which is so arranged as to communicate with said second chamber;

(b) a spool being mounted slidingly in said valve and accommodating a small-diametered portion, a large-diametered portion, an axial opening made in a lower end thereof with a diameter being the same as of said second passage, an upper end plate having several axial holes formed in a radial symmetry therein, a cylindrical projection so formed on a center thereof outwardly as to be inserted into an axial hole made in a valve cover, and annular grooves formed on an outer surface of said small-diametered portion and on a step made in an outer surface between said small-diametered portion and said large-diametered portion thereof; and (c) a valve cover having a cylindrical recess of which inner diameter is the same as the outer diameter of said large-diametered portion of said spool, an axial hole in order for said cylindrical projection of said spool to be fitted slidingly therein, an annular groove so formed on an outer surface thereof as to be communicated with a depressurized chamber, and declined passages intended for connecting said annular groove with said depressurized chamber.

3. A hydropneumatic hammer as set forth in claim 1 wherein the height of the step of said third chamber is greater than or the same as that of said first chamber.

* * * * *